US005217100A

United States Patent [19]

Thompson et al.

[11] Patent Number: 5,217,100

[45] Date of Patent: Jun. 8, 1993

[54] DEVICE FOR GUIDING COINS

[75] Inventors: Trevor Thompson, Nr.Andover; Keith J. Watkins, Wokingham, both of United Kingdom

[73] Assignee: Mars Incorporated, McLean, Va.

[21] Appl. No.: 793,352

[22] PCT Filed: Jul. 2, 1990

[86] PCT No.: PCT/GB90/01020

§ 371 Date: Jan. 8, 1992

§ 102(e) Date: Jan. 8, 1992

[87] PCT Pub. No.: WO91/01030

PCT Pub. Date: Jan. 24, 1991

[30] Foreign Application Priority Data

Jul. 13, 1989 [GB] United Kingdom ..... 8916037

[51] Int. Cl.[5] ..... G07F 1/04

[52] U.S. Cl. ..... 194/346; 453/3

[58] Field of Search ..... 194/346, 317, 318, 319; 453/3, 5, 9, 15

[56] References Cited

U.S. PATENT DOCUMENTS 3,916,922 11/1975 Prumm ..... 194/346 X
4,082,099 4/1978 Iwersen .
4,263,924 4/1981 Johnson ..... 453/5

FOREIGN PATENT DOCUMENTS 625214 2/1936 Fed. Rep. of Germany ..... 194/346
3512579 10/1986 Fed. Rep. of Germany .
3718979 12/1988 Fed. Rep. of Germany .

*Primary Examiner*—F. J. Bartuska

[57] ABSTRACT

A device for guiding an arriving coin, which is travelling edgewise, to a selected one of a plurality of exits of the device, comprising a guide having a coin entry to admit arriving coins and a coin outlet, the guide being of changeable configuration, and a guide control mechanism adapted to selectively position the coin outlet in register with any selected one of the exits, and to change the configuration of the guide as its coin outlet moves between exits. The device can guide coins to numerous exits spaced over a wide range yet is compact in height and width and requires only a single actuator.

25 Claims, 5 Drawing Sheets

DEVICE FOR GUIDING COINS

FIELD OF THE INVENTION

This invention relates to devices for guiding coins to different and selectable paths after they have arrived at an inlet of the device.

The particular devices to be described are designed specifically for guiding coins which have been validated by an electronic coin validator to different paths which respectively lead to different storage locations each for a particular denomination of coin. In that situation, the validator will determine the denomination of the coin, and will control the guiding device so that it will deliver that coin to the path which leads to the correct storage location for coins of that denomination.

BACKGROUND OF THE INVENTION

There is a requirement for different coin denominations to be stored separately, in coin mechanisms which have to give change, for example in vending machines, and in coin mechanisms which have to pay out prizes, for example in gaming machines.

Devices for separating incoming coins onto different paths have generally been referred to as coin sorters and include passive types and active types. In passive coin sorters, such as window sorters, the path of the coins is provided with fixed mechanical features so designed that coins of different denominations, because of their different dimensions, will depart from the path at different points and thereafter will travel to different storage locations. As the number of different denominations to be sorted increases, it becomes more and more difficult to design passive sorters that will operate reliably, and they become undesirably large. In active coin sorters, typically, a group of independently solenoid actuated gates is provided which can be switched into different configurations to divert an incoming coin onto any one of a number of outlet paths. These also tend to become bulky as the number of coin denominations to be sorted increases, and the plurality of actuators required makes them fairly costly and increases the chance of mechanical or electrical failure.

SUMMARY OF THE INVENTION

The present invention aims to improve upon the performance and dimensions of the most commonly used coin sorters or guides in various different ways.

The invention provides a device for guiding an arriving coin, which is travelling edgewise, to a selected one of a plurality of exits of the device, comprising a guide having a coin entry to admit arriving coins and a coin outlet, and guide control means adapted to selectively position the coin outlet in register with any selected one of the exits, characterised in that the guide includes movable portions adjacent respectively to its entry and to its outlet so that the guide is of changeable configuration, and in that the guide control means is adapted to move said movable portions so as to change the configuration of the guide as its coin outlet moves between exits.

The invention, by virtue of the changeable configuration of the guide and the co-ordination of its configuration changes with the positioning of its outlet, enables the height and width of the device to be kept modest in relation to the number of different exits to which it is capable of guiding coins. This is especially the case when, as in the embodiments to be described, the exits involved are relatively numerous, closely-spaced, yet with extreme exits widely spaced apart, and are desired to have the coins emerge from them on substantially parallel paths. The invention also enables very sharp changes of direction of the guided coins to be avoided or, to put it another way, for the paths of the coins to be relatively smooth, which helps to maximise the number of coins per unit time that can be routed to appropriate exits.

Because the guide configuration changes according to the exit selected, the guide control means need only include a single motor or actuator for imposing the changes of configuration and of exit.

From a further aspect, the invention provides a device for guiding an arriving coin to a selected one of a plurality of exits of the device, comprising a guide for receiving arriving coins, the guide being movable to deliver the coin to any selected one of the exits, and characterised by an accept/reject gate movable with the guide and located in the path of the coin through the guide, said gate being selectively operable to an accept position in which it permits the coin to be delivered by the guide to the selected exit and to a reject position in which the gate directs the coin on to an alternative, reject, path out of the device.

Preferably, but not essentially, the gate is an accept-/reject gate and the alternative path is a coin reject path.

This aspect of the invention in particular helps to minimise the height of any coin mechanism which involves both guiding coins for sorting purposes and also accepting or rejecting them, because at least to a degree the regions in which the coin is being guided on the one hand and accepted or rejected on the other hand can be made to overlap in the vertical direction.

BRIEF DESCRIPTION OF THE DRAWINGS

In order that the invention may be more clearly understood, two embodiments thereof will now be described, by way of example, with reference to the accompanying diagrammatic drawings in which.

DETAILED DESCRIPTION

Figure 1A:
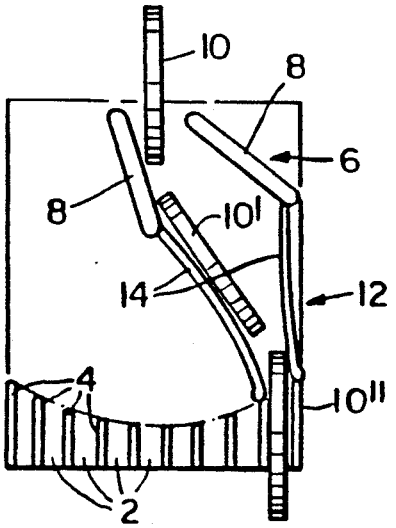
FIGS. 1(*a*) to (*d*) show one embodiment of a coin guiding device in accordance with the invention, FIGS. 1(*a*) and 1(*c*) showing it in one of its possible guiding positions and FIGS. 1(*b*) and (*d*) showing it in another.

Referring first to FIG. 1, the guiding device shown has nine exits 2 which are defined by vanes 4, the exits being relatively closely spaced and arranged to have coins emerge from them substantially parallel and in a downward direction.

A coin guide, which is of changeable configuration, comprises a first, upper, portion 6 and a second, lower, portion 12. First portion 6 comprises two swinging links 8 which are pivoted at their upper ends, the gap between them at their upper ends constituting an entry opening for coins arriving at the device, such coins being indicated at 10. The inner surfaces of swinging links 8 guide entering coins.

The second guide portion 12 is constituted by two sides 14 which are not fixed together but are pivotally supported at the lower ends of the respective swinging links 8.

A guide control means is provided (which may be of the type to be described in more detail below) which is capable of selectively moving the lower end of the second guide portion 12 into register with any one of the coin exits 2, and the guide control means is so arranged that as this traversing of the exits occurs, the swinging links 8 and sides 14 are constrained to move in a particular way, and in coordination with each other, in a manner which can be interpreted from the two particular positions shown in FIG. 1. The movement of the first guide portion formed by swinging links 8 is relatively easy to envisage. They always diverge from each other and turn from side to side in unison.

Figure 1B:
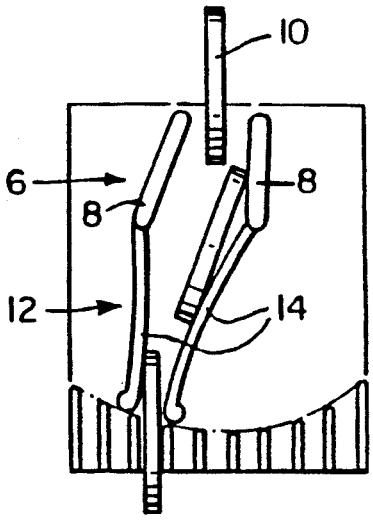
Figure 1C:
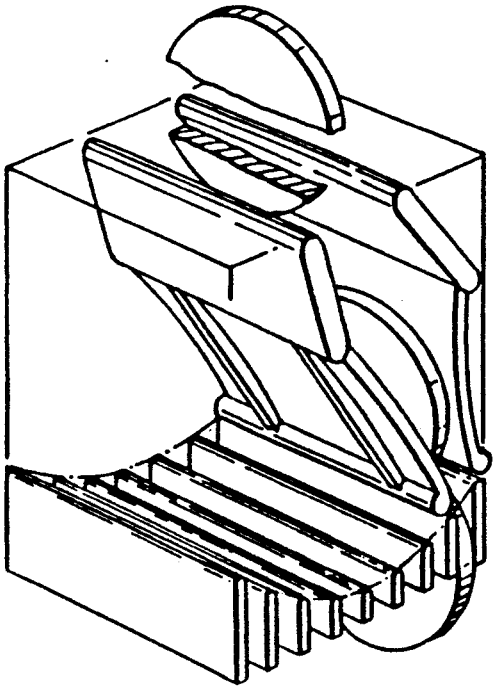
Figure 1D:
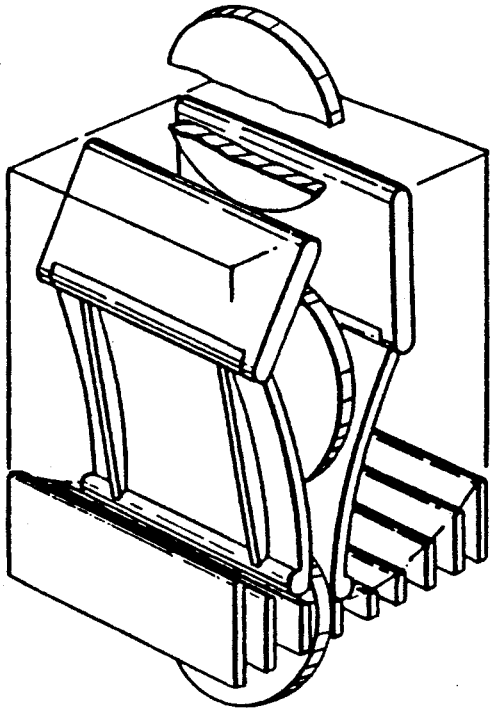

The movement of the second guide portion 12 is more complex and involves both rotation and also bodily translation. The second guide portion 12 translates bodily between the extreme right-hand position shown in FIG. 1*a* and an extreme left-hand position which is the mirror-image of that shown in FIG. 1*a*. Hence its coin outlet moves across the substantial distance covered by the relatively large number of coin exits 2, even though the guide portion 12 is of modest size. Because of the translation, the upper end of guide portion 12 moves from side to side and, when in its extreme positions especially, is not perfectly placed to reliably receive the incoming coin 10. However, the inner surfaces of swinging links 8 ensure that the coins do nevertheless enter the lower guide portion 12 The two sides 14 of the guide portion 12 diverge from each other in the direction away from the exits 2, i.e. upwards, so there is plenty of space in which the coin can make the movements necessary to transfer through the inlet and then from the first guide portion into the second guide portion. However, although the upper end of the second guide portion 12 is relatively broad owing to its divergence, there is no need for the overall width of the device to be increased to accommodate this extra breadth when the second guide portion 12 is translated from one to the other of its two extreme positions. This is because, at the same time as the translational movement, the second guide portion 12 rotates. In FIG. 1*a* it has rotated anti-clockwise relative to its central position, such that the right-hand side 14 is approximately vertical. As it translates to the left as shown in FIG. 1*b* it rotates clockwise and when it reaches the extreme left-hand position the left-hand side 14 will be substantially vertical. Hence, because when the coin outlet from lower guide portion 12 is in each of the two extreme lateral positions, the laterally extreme sides 14 occupy substantially parallel positions adjacent to the respective extreme outlets, the width of the device need be little or no greater than the width required to accommodate the exits 2, despite the divergent shape of the second guide portion 12.

The effect is that the lower guide portion 12 is rotated as though about a centre located substantially above the top of the device as viewed in FIG. 1. This is achieved by pivoting the sides 14 of the second guide portion 12 independently at the lower ends of the swinging links 8, and hence without any part of the mechanism needing to extend outside the rectangular outline indicated in FIG. 1.

A coin 10′ is shown in FIG. 1(*a*) sliding down the left-hand side 14 towards the extreme right-hand exit 2. It is desired that the coin 10′ emerge through and from the exit 2 edgewise and substantially vertically as illustrated by the coin 10″ and for this to happen the coin must rotate substantially clockwise when its leading edge is entering the exit. The right-hand side 14 directs the leading edge towards the exit and, because the right-hand side 14 is substantially vertical it leaves plenty of free space (between itself and the coin 10′ in FIG. 1(*a*)) to allow the coin to turn clockwise under gravity and enter the extreme right-hand exit 2 with minimal hindrance. It will be appreciated that this turning space for the coin, in conjunction with the steeply inclined left-hand side 14 for speedily guiding the coin towards its exit, could not be made available by pivoting the second guide portion 12 at a point within the confines of the device, for example in the vicinity of the coin entry, and arises because the second guide portion 12 is effectively swung about a centre quite substantially outside the device.

Still referring to FIG. 1(*a*), it can be seen that the first guide portion 6, and in particular the left-hand swinging link 8, is already starting to guide the arriving coin 10 in the general direction of the extreme right-hand exit (indeed, this could be occurring even before the lower end of the second guide portion 12 has arrived fully in register with that exit) and the upper end of the second guide portion 12 is, because of the geometry, always in a position to receive the partially guided coin from the upper guide 6 and then route it accurately to the desired exit.

In general terms, the complete guide consisting of the first and second guide portions 6 and 12 together, is constrained by control means which will be described in more detail below to change its shape according to which of the exits the lower end of the chute is in register with, such that unhindered delivery of the coin to the selected exit is facilitated, as has been explained. There is substantial overlap between the volumes occupied by the guide in adjacent exit positions, and this enables the volume represented by the rectangular outline of the device as seen in FIG. 1(*a*) to be of relatively small overall dimensions, both in height and width, and to be substantially fully utilised.

Figure 4:
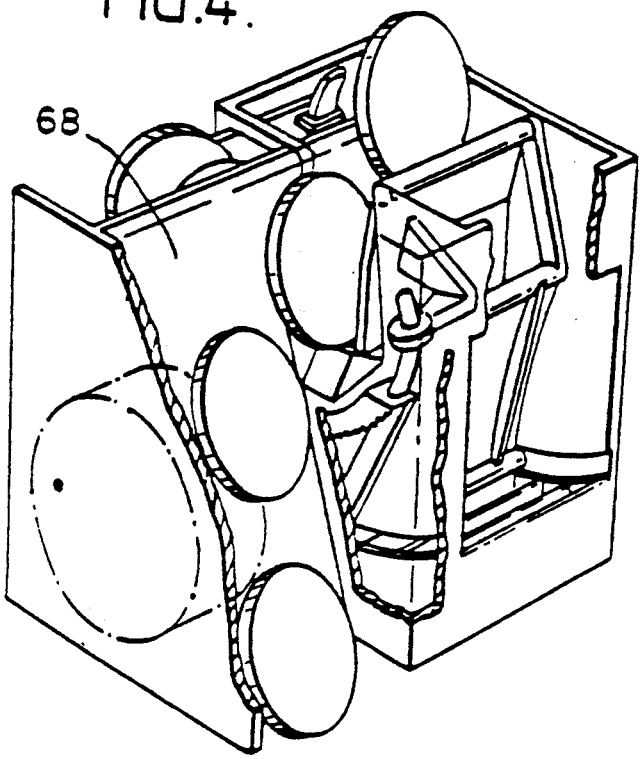
FIGS. 4 and 5 show the device of FIGS. 2 and 3 in its coin rejecting and its coin accepting configurations.
Figure 5:
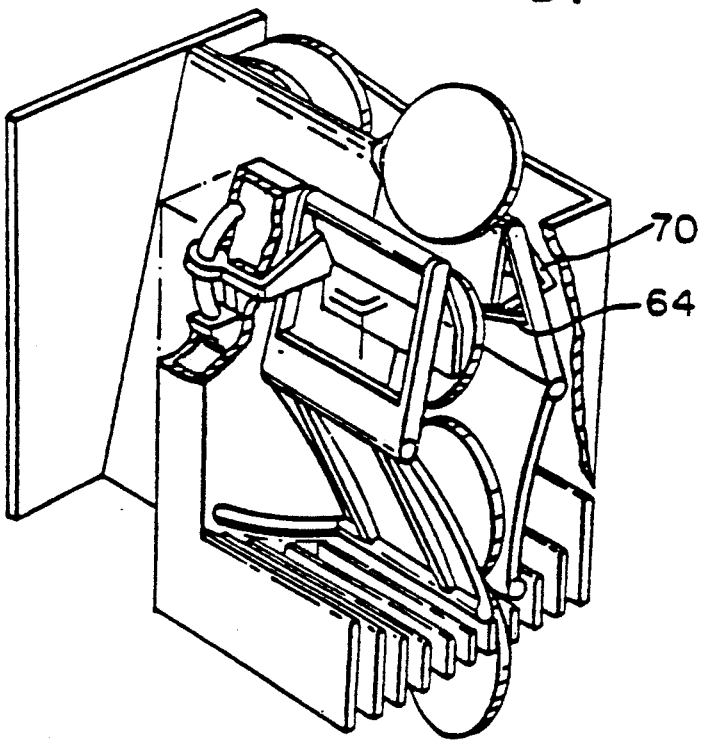
Figure 6:
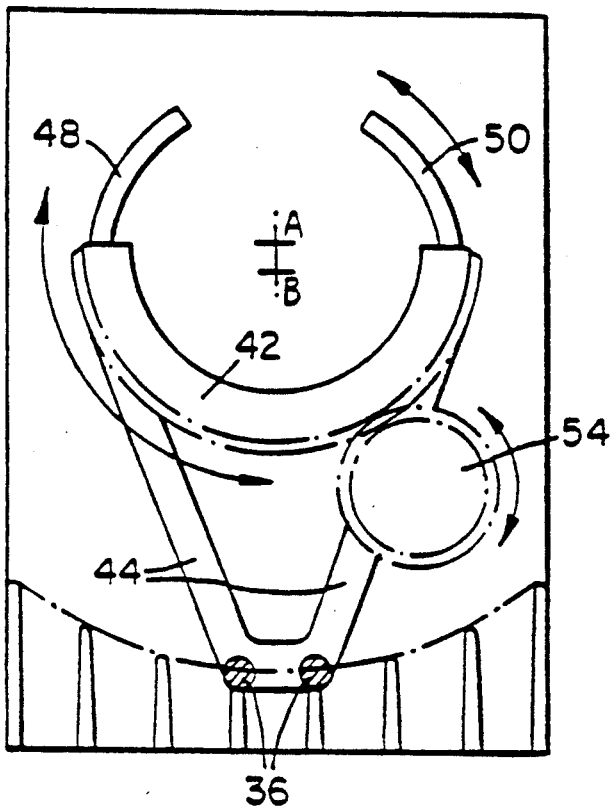
FIGS. 6, 7 and 8 show selected parts of a device identical to that in FIGS. 2 to 5, so far as concerns its moving parts, with the purpose of more clearly illustrating the geometry and manner of movement of the parts in that device, the views all being taken in the direction of arrow X in FIGS. 2 and 3.
Figure 7:
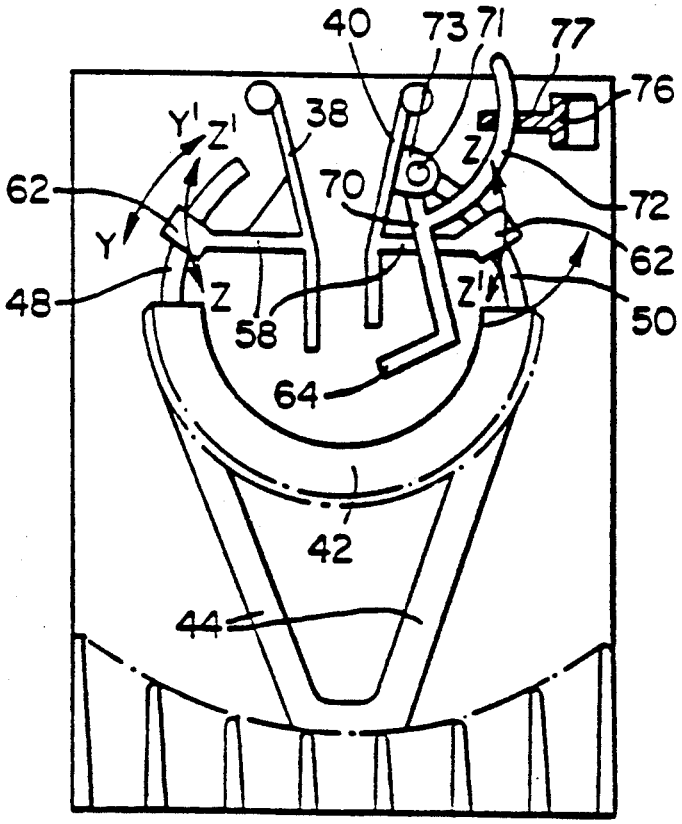
Figure 8:
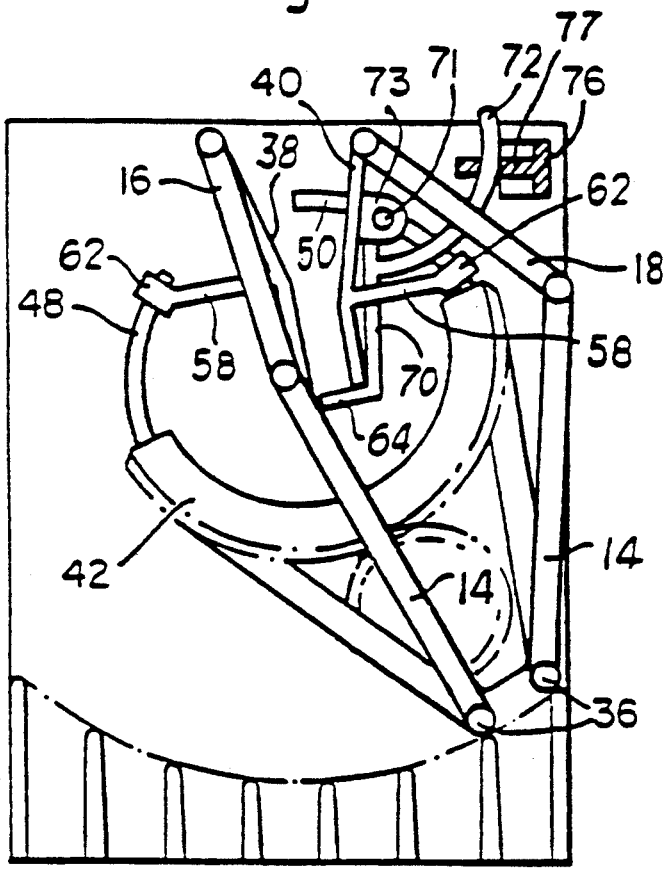

Turning now to FIGS. 2 to 5 and 6 to 8, the device shown is identical in all these Figures except that ten exits 2 are shown in FIGS. 2 to 5 and seven are shown in FIGS. 6 to 8, as compared with the nine exits of the FIG. 1 device. The device shown in these Figures has a second guide portion 12 with independent but coordinated sides 14 but, instead of the solid swinging links 8 which provide guide surfaces in FIG. 1, it has swinging links 16 and 18 in the form of open frames. Although these do not serve a direct guiding function, they are pivoted at their upper ends and the sides 14 are pivoted to them at their lower ends, and therefore they do control the movement of the second guide portion 12, in exactly the same way as did the swinging links 8 in FIG. 1.

The operative parts of the device are housed and supported by a casing which has a front wall 20, two side walls 22 and 24 having openings in them, a rear wall 26 having a hollow box-like structure (best seen in FIG. 3) in which part of the drive mechanism is housed, and, extending from the rear wall a bracket portion having main walls 28 and 30. The vanes 4 extend between the front and rear walls 20 and 26, with the two laterally extreme vanes being actually formed by the lower parts of the side walls 24. The swinging links 16 and 18 are pivoted at their upper edges by means of pivot pins (not shown) engaging in respective recesses in the front and rear walls 20 and 26. The lower edges of the sides 14 are formed with pegs 32 which extend forwardly to ride in and be guided by a quadrant-shaped slot 34 in the front wall 20 (see FIG. 2), and at their rear ends are formed with pegs 36 which extend through a quadrant-shaped aperture 39 into the hollow interior of the rear wall 26.

Figure 2:
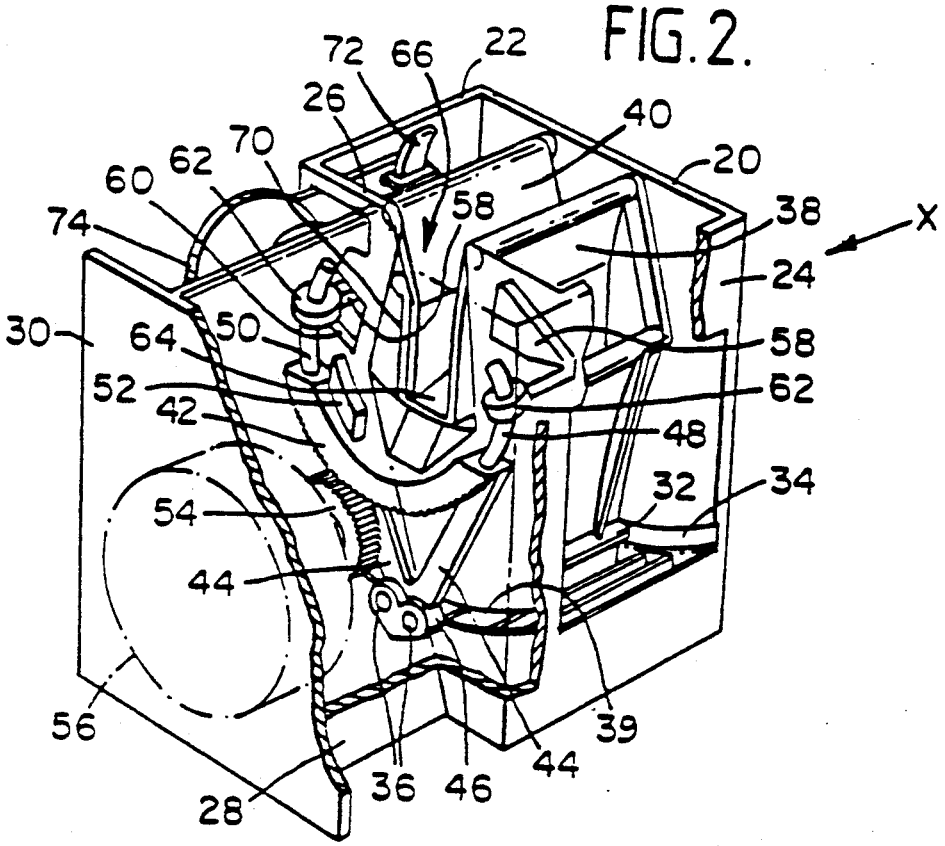
FIGS. 2 and 3 show, partly broken away to reveal a drive mechanism, a coin guiding device which additionally incorporates an accept/reject gate and the necessary actuating arrangements.

In place of the internal surfaces of the swinging links 8 which formed the first guide portion in the FIG. 1 embodiment, the FIG. 2 embodiment has a first guide portion in the form of two movable elements 38 and 40 which are pivoted at their upper ends on pivot pins (not shown) which extend between the front and rear walls 20 and 26, these being the same pivot pins on which the swinging links 16 and 18 are mounted.

By means of a guide control mechanism which will be described, the two elements 38 and 40 forming the first guide portion turn from side to side in coordination with the movement of the sides 14 of the second guide portion 12 but, because the first guide portion is narrower it guides the arriving coin more precisely towards the selected exit as the coin is entering the second guide portion 12.

The guide control means includes a unitary structure which includes an arcuate rack gear 42, a pair of arms 44 extending downwardly from the ends of the rack gear 42 to support at their lower ends a double trunnion 46 into which engage the pegs 36, and a pair of rod-like curved horns 48 and 50 which extend upwardly from the ends of the rack gear 42. The unitary structure just described is located by means of a curved bearing projection 52 of which one portion can be seen in FIG. 2 and another portion in FIG. 3 though the entire projection 52 is in practice a continuous arc; the projection 52 is fixed on the rear surface of the inner part of the box-like rear wall 26 of the casing. The curved bearing projection 52 matches, and serves as a sliding bearing for, the inner arcuate surface of the arcuate rack gear 42 and these two surfaces have the same central axis of curvature (A, in FIG. 6), which is also the central axis of the quadrant slot 34, the quadrant aperture 39, and the rack teeth.

The teeth on the outside of the arcuate rack gear 42 engage with the output gear 54 of a stepper motor 56 which is mounted on the forward-facing surface of the bracket wall 30.

The elements 38 and 40 of the first guide portion are provided with respective angled arms 58 which project back through apertures 60 (only one visible, in FIG. 2, but see FIG. 7) to the interior of the box-like rear wall 26 where the arms 58 are each formed with a trunnion 62 which slidably rides on a respective one of the horns 48 and 50.

When the stepper motor 56 is actuated, the unitary structure 42, 44, 46, 48, 50 is turned or rocked about the axis of curvature A of the arcuate rack gear 42 so that the trunnion 46 acting through pegs 36 positively drives the lower edges of the lower coin guide portion 12 to traverse across the exits 2. The stepper motor 56 can be driven by signals which are derived by standard techniques from a coin validator of any type, which applies one or more tests to a coin, processes the test results to determine whether it is a coin that should be accepted and, if it is, produces a signal indicative of the denomination of the coin which in turn is used to derive a drive signal for the stepper motor such as to cause it to position the lower end of second guide portion 12 in register with that exit 2 which leads to a storage location for that particular denomination of coin.

If the horns 40 and 48 had the same central axis of curvature A as the rack 42, then they would simply slide through the trunnions 62 as the unitary body turns or rocks. However, the horns 48 and 50 are given a lower central axis of curvature (B, see FIG. 6) than the rack 42, that is to say, relative to a circular continuation of the rack the horns curve further inwardly towards each other. The result of this is that the horns have a sliding camming action within the trunnions 62 as the unitary structure rocks. Referring to FIG. 7, as the unitary structure rocks from Y to Y', the trunnions 62 move from Z to Z'. This pushes the arms 58 both in the same direction and these in turn cause the movable elements 38 and 40 to be pivoted in the same direction about their pivot pins. The relative dimensioning is such that the first guide portion formed by elements 38, 40 pivots across only part of the angular range of the exits 2, that is to say it turns through an angle substantially less than the angle through which the lower end of the second guide portion moves as viewed from the entry. Hence the coin does not have to turn sharply when entering the first guide portion.

The device guides incoming coins to the appropriate exit 2 basically in the same way as the device explained in relation to FIG. 1, except for the different manner of operation of the first guide portion (elements 38, 40) which has already been explained. However, the device includes extra features which enable it not only to guide acceptable coins to the appropriate one of the exits 2, but also enable it to route non-acceptable coins to a reject path in response to the associated coin validator determining that a coin is not acceptable.

Figure 3:
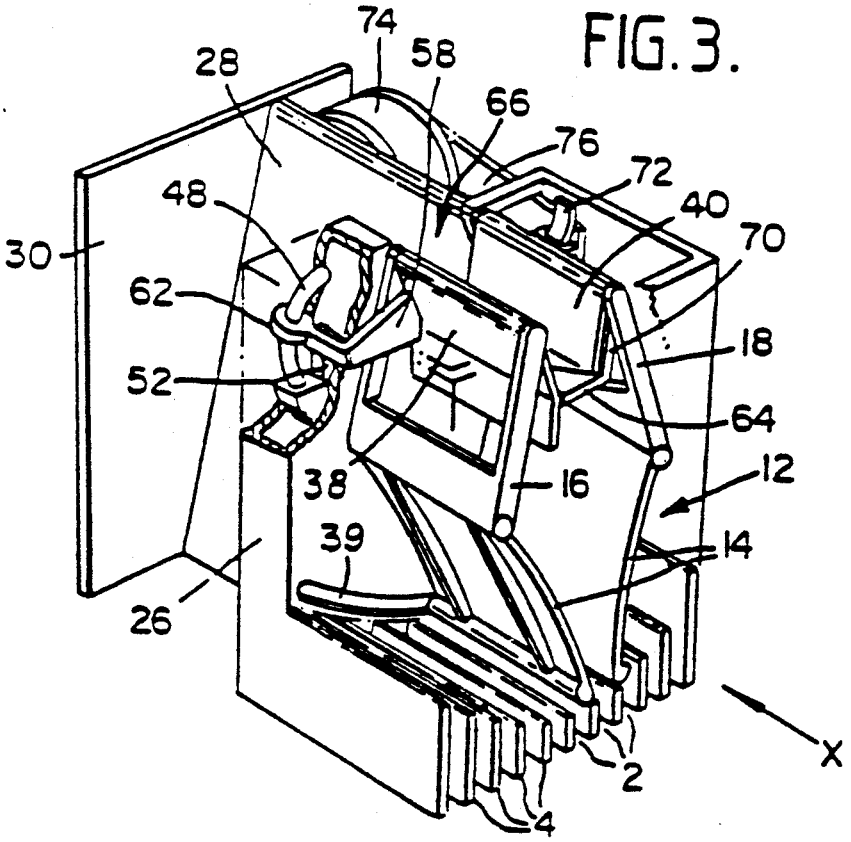

For this purpose, an accept/reject gate in the form of a small plate 64 is provided which in its normal position, as shown in FIGS. 2, 3 and 8 and in full lines in FIG. 7, blocks off the bottom or lower end of the first guide portion formed by the elements 38 and 40. The accept/reject gate 64 slopes downwardly toward the rear wall 26, which has a central cut-out 66 in it where indicated generally by the arrow in FIGS. 2 and 3 so that when a coin arrives and the gate 64 is closed, as shown in FIG. 4, the coin rolls rearwards on the gate 64 through the gap 66 and onto a steep ramp 68 formed by the outer surface of wall 28 of the rear bracket. The sequence of positions occupied by a coin being rejected in this fashion is illustrated in FIG. 4.

The accept gate plate 64 is the lower part of an L-shaped member of which the upper part is a plate 70 which is pivotally mounted at its upper edge to the outside of element 40 by means of a pin 71 in lugs 73. Unitary with the L-shaped member 64, 70 is an arcuate lever 72 (see also FIGS. 7 and 8). The arcuate lever 72 is shaped such that its centre of curvature lies on the axis about which element 40 pivots. The accept/reject gate is operated by means of a solenoid 74 mounted behind bracket wall 28 and having an actuator arm 76 (see FIGS. 3, 7 and 8) which extends through an aperture in the rear wall 26 of the casing (which at this position is single, rather than box-like) so as to lie behind the lever 72. Actuator arm 76 includes (see FIGS. 7 and 8) a lug 77 having an aperture therein through which lever 72 extends, and by means of which the actuator arm 76 pushes lever 72 inwardly when the solenoid 74 is activated, this being done when the solenoid 74 receives from the associated coin validator a signal indicating arrival of a coin which is acceptable and is to be permitted to be directed to one of the exits 2. It is to be noted that because the centre of curvature of lever 72 coincides with the axis about which it moves, its point of contact with lever 76 remains constant as the outside of the lever slides across the surface of the arm 76, and this point of contact always lies above the axis 71 on which the L-shaped member is pivoted. Consequently, irrespective of the instantaneous angular position of the mechanism, whenever lever 72 is pushed towards the first guide portion 38, 40, by the actuator arm 76, it causes the entire L-shaped member 64, 70 to pivot outwardly to the position shown in FIG. 5 and in broken lines in FIG. 7 so that the plate 64 no longer obstructs the bottom of the first guide portion and the coin can leave the bottom thereof freely.

FIG. 5 shows the sequence of positions occupied by a coin which is acceptable and is therefore to be allowed to pass the accept/reject gate and be routed to one of the more right-hand exits 2.

The device just described enables a reduction in the dimensions of a complete coin validation and routing system because it can be appreciated that the location of the accept/reject gate 64 within the guide requires virtually no additional space for the additional function of acceptance/rejection, beyond that needed for guidance. Furthermore, because the accept/reject gate 64 is located below the upper guide portion 38, 40, the process of guiding the coin to its eventual exit can already have been started before the accept/reject gate 64 is opened which enables the functions of acceptance and guidance to an exit to be accomplished within a shorter time.

It should be appreciated that the exits 2 and vanes 4 which define them might alternatively be provided as a separate unit from the movable parts of the guidance system or as a part of a separate unit therefrom.

It should be noted that, in the present invention the guide for the coin to its final destination is always formed by the same elements, whereas in prior art active sorter devices typically the coin is guided by a different selection of the various movable elements, the selection depending upon which exit the coin has to be guided to.

We claim:

1. A device for guiding an arriving coin, which is travelling edgewise, to a selected one of a plurality of exits of the device, comprising a guide having a coin entry to admit arriving coins and a coin outlet, and guide control means adapted to selectively position the coin outlet in register with any selected on of the exits, wherein the guide includes movable portions adjacent respectively to its entry and to its outlet so that the guide is of changeable configuration, and in that the guide control means is electrically powered and is adapted to move both of said movable portions so as to change the configuration of the guide as its coin outlet moves between exits.

2. A device as claimed in claim 1 wherein the guide includes a first portion adjacent to its inlet and a second portion adjacent to its outlet, and the guide control means is adapted to translate the second portion across said exits and position the outlet in register with any exit, and to move the first portion in coordination with the second portion to direct arriving coins into the second portion.

3. A device as claimed in claim 2 wherein the coin outlet moves through a predetermined angle, as viewed from the entry, when it moves between the two laterally extreme exits, and the guide control means is adapted to turn the first guide portion through an angle substantially less than said predetermined angle as that movement of the coin outlet of the second guide portion occurs.

4. A device as claimed in claim 2 wherein the coin outlet moves through a predetermined angle, as viewed from the entry, when it moves between the two laterally extreme exits, and the guide control means is adapted to rotate the second guide portion through an angle less than the predetermined angle as that movement of its coin outlet occurs.

5. A device as claimed in claim 4 wherein said second guide portion has two opposed sides which diverge away from the exits.

6. A device as claimed in claim 5 wherein, by virtue of the rotation of the second guide portion, one opposed side and the other opposed side lie in substantially parallel planes when the coin outlet is in register with respective ones of said two extreme exits.

7. A device as claimed in claim 2, wherein the second guide portion has two opposed sides, two ends of the two sides define the outlet, and each side is pivotally suspended at its other end from one end of a respective swinging link, and the other ends of the swinging links are pivoted at opposite sides of the entry.

8. A device as claimed in claim 7 wherein the two sides diverge away from the exits.

9. A device as claimed in claim 7 wherein the guide control means includes means for driving the outlet-defining ends of the two sides along an arcuate path to move the outlet across the exits.

10. A device as claimed in claim 9 wherein said driving means comprises a motor having an output gear, a rack gear which engages with said output gear and which is arcuate about the same axis as said arcuate path, and means connecting the arcuate rack gear to the outlet-defining ends of the two sides to move those ends along said arcuate path.

11. A device as claimed in claim 10 wherein the lengths of the swinging links and the lengths of the sides are selected such that the second guide portion formed by the two sides rotates bodily about an axis which is substantially farther from the exits than is the axis of the arcuate rack gear.

12. A device as claimed in claim 7 wherein the swinging links include coin guiding surfaces which form said first portion of the guide.

13. A device as claimed in claim 7, wherein said first portion of the guide comprises two elements, one on each side of the entry, and the guide control means is adapted to turn the two elements in the same direction as the translation of the second portion of the guide, to direct arriving coins into the second portion.

14. A device as claimed in claim 13 wherein said two elements are mounted to turn about separate axes.

15. A device as claimed in claim 14 wherein the mounting axes of said two elements coincide with the pivots of said swinging links.

16. A device as claimed in claim 10 wherein said first portion of the guide comprises two elements one on each side of the entry, and the guide control means is adapted to turn the two elements in the same direction as the translation of the second portion of the guide, to direct arriving coins into the second portion, and wherein the guide control means comprises means coupling said two elements to said arcuate rack gear for movement thereby.

17. A device as claimed in claim 16 wherein the coupling means comprises arcuate elements integral with the arcuate rack gear but having a different centre of curvature therefrom, and respective actuating arms on said two elements, which arms engage with respective arcuate elements.

18. A device as claimed in claim 13 comprising a gate element selectively movable to open and close the exit from the first guide portion.

19. A device as claimed in claim 18 wherein the gate element slopes to cause a coin to roll off it when the gate is closed.

20. A device as claimed in claim 18 wherein the gate element is pivotally mounted on one of the elements forming the first guide portion, so as to turn therewith.

21. A device as claimed in claim 20 wherein the gate element is opened and closed by pivotal movement, about its pivotal mounting, relative to the element it is mounted on.

22. A device as claimed in claim 21 wherein the gate element is provided with an arcuate lever whose centre of curvature coincides with the pivotal axis of the element which the gate element is mounted on.

23. A device as claimed in claim 22 comprising gate actuator means operable to push on said arcuate lever to actuate the gate element.

24. A device as claimed in claim 1 wherein the guide control means comprises a single motor and means for converting output motion of the motor to a change in coin outlet position, and a corresponding change in configuration of the guide.

25. A device for guiding an arriving coin to a selected one of a plurality of exits of the device, comprising a guide for receiving arriving coins, the guide being movable to deliver the coin to any selected one of the exits, and wherein an accept/reject gate is moveable with the guide and is located in the path of the coin through the guide, said gate being selectively operable to an accept position in which it permits the coin to be delivered by the guide to the selected exit and to a reject position within the guide in which reject position the gate obstructs the coin path through the guide and directs the coin on to an alternative, reject, path out of the device.

* * * * *